US012453374B2

(12) United States Patent
Besso et al.

(10) Patent No.: US 12,453,374 B2
(45) Date of Patent: Oct. 28, 2025

(54) AEROSOL-GENERATING DEVICE WITH SWITCH

(71) Applicant: PHILIP MORRIS PRODUCTS S.A., Neuchâtel (CH)

(72) Inventors: Clement Besso, Neuchâtel (CH); Ricardo Cali, Mannheim (DE); Thomas Philipp Salvador, Tiefenbach (DE)

(73) Assignee: Philip Morris Products S.A., Neuchâtel (CH)

( * ) Notice: Subject to any disclaimer, the term of this patent is extended or adjusted under 35 U.S.C. 154(b) by 480 days.

(21) Appl. No.: 17/790,886

(22) PCT Filed: Jan. 5, 2021

(86) PCT No.: PCT/IB2021/050044
§ 371 (c)(1),
(2) Date: Jul. 5, 2022

(87) PCT Pub. No.: WO2021/140436
PCT Pub. Date: Jul. 15, 2021

(65) Prior Publication Data

US 2022/0369705 A1 Nov. 24, 2022

(30) Foreign Application Priority Data

Jan. 7, 2020 (EP) ..... 20150512

(51) Int. Cl.
*A24F 40/40* (2020.01)
*A24F 40/51* (2020.01)

(52) U.S. Cl.
CPC ..... *A24F 40/40* (2020.01); *A24F 40/51* (2020.01)

(58) Field of Classification Search
None
See application file for complete search history.

(56) References Cited

U.S. PATENT DOCUMENTS

2012/0042884 A1* 2/2012 Mukaddam ..... A24F 40/65 131/173
2016/0066619 A1 3/2016 Di Carlo
(Continued)

FOREIGN PATENT DOCUMENTS

CN 110301683 A 10/2019
DE 102017001555 8/2018
(Continued)

OTHER PUBLICATIONS

Extended European Search Report for EP 20150512.0 issued by the European Patent Office;Jul. 15, 2020; 9 pgs.
(Continued)

*Primary Examiner* — Philip Y Louie
*Assistant Examiner* — Jeffrey A. Buckman
(74) *Attorney, Agent, or Firm* — Mueting Raasch Group

(57) ABSTRACT

An aerosol-generating device has a body configured to receive an aerosol-generating substrate; a heating element configured to heat the aerosol-generating substrate; a power source operatively connected to the heating element; a controller configured to control the power source and the heating element; and a switch comprising a sensor to detect presence of an actuator. The switch is operatively connected to the controller. A method for using the aerosol-generating device includes placing the actuator adjacent the sensor and detecting the presence of the actuator; and controlling power supply to the heating element.

17 Claims, 3 Drawing Sheets

(56) References Cited

U.S. PATENT DOCUMENTS

| | | | | |
|---|---|---|---|---|
| 2016/0206000 | A1* | 7/2016 | Lord | A24F 40/53 |
| 2017/0013879 | A1* | 1/2017 | Frisbee | A24F 40/40 |
| 2021/0037890 | A1 | 2/2021 | Du et al. | |
| 2021/0259305 | A1* | 8/2021 | Hagen | A24F 1/30 |

FOREIGN PATENT DOCUMENTS

| | | |
|---|---|---|
| GB | 2534214 | 7/2016 |
| WO | 20070042941 | 4/2007 |
| WO | 20150082560 | 6/2015 |
| WO | 20190003116 | 1/2019 |

OTHER PUBLICATIONS

International Search Report and Written Opinion for PCT/IB2021/050044, issued by the European Patent Office, Mar. 12, 2021; 13 pgs.

Chinese Office Action for CN 202180007171.5 issued by the China National Intellectual Property Administration on Apr. 23, 2025; 18 pgs. including English translation.

* cited by examiner

AEROSOL-GENERATING DEVICE WITH SWITCH

This application is the § 371 U.S. National Stage of International Application No. PCT/IB2021/050044, filed 5 Jan. 2021, which claims the benefit of European Application No. 20150512.0, filed 7 Jan. 2020, the disclosures of which are incorporated herein by reference.

This disclosure relates to aerosol-generating devices comprising a switch. This disclosure relates to aerosol-generating devices comprising docking station for a mouthpiece.

Traditional shisha devices are used to smoke tobacco and are configured such that vapor and smoke pass through a water basin before inhalation by a consumer. Shisha devices may include one outlet, or more than one outlet so that the device may be used by more than one consumer at a time. Use of shisha devices is considered by some to be a leisure activity and a social experience.

Typically, traditional shishas are used in combination with a substrate, sometimes referred to in the art as hookah tobacco, tobacco molasses, or simply as molasses. Traditional shisha substrates are relatively high in sugar (in some cases, up to ~50% vs. the ~20% typically found in conventional tobacco substrates, such as in combustible cigarettes). The tobacco used in shisha devices may be mixed with other ingredients to, for example, increase the volume of the vapor and smoke produced, to alter flavor, or both.

Traditional shisha devices employ charcoal, such as charcoal pellets to heat and sometimes combust the tobacco substrate to generate an aerosol for inhalation by a user. Using charcoal to heat the tobacco may cause full or partial combustion of the tobacco or other ingredients. Additionally, charcoal may generate harmful or potentially harmful products, such as carbon monoxide, which may mix with the shisha vapor and pass through the water basin to the outlet.

One way to reduce the production of carbon monoxide and combustion by-products is to employ e-liquids rather than tobacco. Shisha devices that employ e-liquids eliminate combustion by-products but deprive shisha consumers of the traditional tobacco-based experience.

Other shisha devices have been proposed that employ electric heaters to heat, but not combust, tobacco. Such electrically heated heat-not-burn shisha devices heat the tobacco substrate to a temperature sufficient to produce an aerosol from the substrate without combusting the substrate, and therefore reduce or eliminate by-products associated with combustion of tobacco.

Shisha devices may employ a cartridge for housing an aerosol-forming substrate. The cartridge may be filled with such aerosol-forming substrate. The aerosol-forming substrate may comprise tobacco, preferably shisha substrate, such as molasses—a mixture of tobacco, water, sugar, and other components, such as glycerine, flavors, etc. The heating system of the electrically heated shisha device heats the contents of the cartridge to generate aerosol, which is conveyed through an airflow path to a user.

In order to facilitate airflow through the cartridge and the flow of the aerosol from the cartridge, a shisha cartridge may have one or more holes through one or more walls. The cartridge may include one or more holes at the top, one or more holes at the bottom, or both one or more holes at the top and one or more holes at the bottom. The holes may also be disposed along the sides of the cartridge. Alternatively, the top may be open, that is, the top wall may be partially or completely absent. Any holes or openings in the top and bottom walls may be closed by a removable (for example, peelable) sealing layer, such as a film, sticker, or liner, during storage. The removable layer may protect the contents (for example, the molasses) from exposure to air and oxygen. The removable layer may be removed (for example, pulled or peeled off) by a user prior to first use of the cartridge.

The holes or openings in the cartridge, if left unsealed, may lead to loss of freshness (for example, moisture content) or contamination of the substrate, as well as issues with leakage. For one or more reasons, such as in order to maintain freshness, to prevent leakage of the substrate, or to preserve the quality and integrity of the substrate during storage, it is desirable to close or seal the openings or holes of the cartridge prior to use or between uses if the entire contents of the cartridge are not used at once.

Aerosol-generating devices, such as shisha devices, typically comprise a vessel containing liquid, and a conduit in fluid communication with the vessel and the receptacle for housing the aerosol-forming substrate. The vessel may comprise a headspace above the liquid, and an outlet between the headspace and an outside of the vessel. The headspace outlet may be coupled to a hose comprising a mouthpiece for delivering the aerosol to a consumer.

While a user is using an aerosol-generating device (such as a shisha device), the user may wish to pause using the aerosol-generating device. The user may then wish to continue using the aerosol-generating device after pausing use. The user may wish any temperature adjustment, such as increasing and lowering of the temperature, to be automatic during use of the device. While a user pauses using the aerosol-generating device, the user may wish to set down the mouthpiece in a convenient and hygienic manner.

Shisha devices with an activation element in the mouthpiece have been proposed. The activation element may include a switch activatable by a user or a puff sensor arranged to detect a user puffing on the mouthpiece. The activation element is operably coupled to the control electronics of the aerosol-generating device. Activation of the activation element may cause the control electronics to activate the heating element.

It would be desirable to provide an aerosol-generating device with an alternative switching mechanism. It would be desirable to provide an aerosol-generating device which may easily be switched between two or more operational modes. It would be desirable to provide an aerosol-generating device with improved power management. It would be desirable to provide an aerosol-generating device with improved energy efficiency. It would be desirable to provide an aerosol-generating device which may easily be switched from an aerosol-generating mode to a standby mode to conserve energy. It would be desirable to provide an aerosol-generating device which may easily be switched off to conserve energy. It would be desirable to provide an aerosol-generating device capable of being switched from one operating mode to another depending on the presence or absence of an actuator. It would be desirable to provide an aerosol-generating device capable of being switched from one operating mode to another by contacting the device with an actuator. It would be desirable to provide an aerosol-generating device capable of switching the heating element to a stand-by mode or off when the mouthpiece handle is docked.

According to an embodiment of the present disclosure, an aerosol-generating device comprises an alternative switching mechanism. The aerosol-generating device may comprise a system enabling the device to be easily switched between two or more operational modes. The aerosol-generating device may comprise a system enabling the device to be easily switched from an aerosol-generating mode to off or to a standby mode. The aerosol-generating device may comprise a system enabling the device to be easily switched between an aerosol-generating mode and a standby mode. The aerosol-generating device may comprise a switch comprising a sensor to detect the presence of an actuator. The actuator may be the handle of a mouthpiece. The switch may provide the capability to detect the presence of the mouthpiece handle. According to an embodiment of the present disclosure, an aerosol-generating device comprises a docking station for a mouthpiece handle. The docking station may be capable of detecting the presence of the mouthpiece handle.

According to an embodiment of the present disclosure, an aerosol-generating device is capable of being switched from one operating mode to another using a magnetic switch. The aerosol-generating device may be capable of being switched from one operating mode to another by contacting the device with an actuator. The aerosol-generating device may be capable of being switched from one operating mode to another by contacting the device with the mouthpiece handle.

According to an embodiment of the present disclosure, an aerosol-generating device comprises a docking station for the mouthpiece handle. The docking station for the mouthpiece handle may be capable of switching the heating element to a stand-by mode when the mouthpiece handle is docked. The docking station for the mouthpiece handle may be capable of switching the heating element off when the mouthpiece handle is docked. The docking station for the mouthpiece handle may be capable of switching the heating element to an aerosol-generating mode when the mouthpiece handle is removed from the docking station.

According to an embodiment, the switch may comprise a magnetic mechanism. The switch may comprise a magnetic docking station for the actuator. For example, the switch may comprise a magnetic docking station for the handle of the mouthpiece. The aerosol-generating device allows the user to dock the mouthpiece on the device body.

The aerosol-generating device may comprise one or more heating elements or heating element components. Different heating element components may work in concert or may be configured to work separately during different operating modes. The aerosol-generating device may comprise a heating element that is capable of heating the aerosol-generating substrate to an aerosol-generating temperature from the stand-by temperature quickly. The device may comprise an inductive heating component that is capable of heating the aerosol-generating substrate to an aerosol-generating temperature quickly.

The aerosol-generating device may comprise a first heating element component for pre-heating. The aerosol-generating device may comprise a first heating element component for maintaining a stand-by temperature in the stand-by mode. The first heating element component may comprise a resistive heating component.

The aerosol-generating device may comprise a second heating element component for heating to an aerosol-generating temperature in the aerosol-generating mode. The second heating element component may comprise an inductive heating component.

The aerosol-generating device may allow a user to conveniently set the heating element of the device to a stand-by mode and to an aerosol-generating mode. For example, the device may allow the user to set the heating element to a stand-by mode when the user intends to pause using the device. The device may allow the user to set the heating element to an aerosol-generating mode when the user intends to use the device. The device may automatically set the heater to a stand-by mode when an actuator is placed on the switch (for example, adjacent the sensor) on the device body. The device may automatically set the heater to an aerosol-generating mode when the actuator is moved or removed from the switch (for example, is picked up by a user). According to an embodiment, the device conserves energy by allowing the heating element to be heated to a lower temperature in the stand-by mode.

The device allows a user to conveniently set the heating element of the device to a stand-by mode and to an aerosol-generating mode. For example, the device allows the user to set the heating element to a stand-by mode when the user intends to pause using the device. The device allows a user to conveniently set the heating element to an aerosol-generating mode when the user intends to use the device. The device may automatically set the heater to a stand-by mode when an actuator is placed on the switch (for example, on or adjacent the sensor) on the device body. The device may automatically set the heater to an aerosol-generating mode when the actuator is moved or removed from the switch (for example, picked up by a user).

The device beneficially conserves energy by allowing the temperature of the heating element to be lowered in the stand-by mode, or allowing the heating element to be turned off when use is paused.

The actuator may be the handle of a mouthpiece. The switch may comprise a docking station for the actuator (for example, mouthpiece). A user may conveniently indicate the intention to use the device simply by picking up the mouthpiece from the docking station of the device. A user may conveniently indicate the intention to pause or stop using the device by placing the mouthpiece on the docking station.

The device may provide a convenient docking station for the mouthpiece on the device body. One or both of the docking station and the mouthpiece may comprise a magnet. In one embodiment, the docking station comprises a magnet and the mouthpiece is configured to be held in place by the magnet. In one embodiment, the mouthpiece comprises a magnet and the docking station comprises a corresponding magnetic coupling element. The docking station may comprise a mechanical seat configured to support the mouthpiece. The docking station may comprise a contact point configured to contact a part of the mouthpiece. The mouthpiece may comprise a mouthpiece handle. The mouthpiece may comprise a mouthpiece body. The mouthpiece may comprise a mouthpiece a coupling element configured to couple with the docking station. The coupling element may be a part of the body or handle.

According to an embodiment of the present disclosure, an aerosol-generating device may comprise a body configured to receive an aerosol-generating substrate; a heating element configured to heat the aerosol-generating substrate; a power source operatively connected to the heating element; a controller configured to control the power source and the heating element; and a switch comprising a sensor to detect presence of an actuator, the switch being operatively connected to the controller. The switch may comprise a magnetic switch. The switch may comprise a magnetic docking station configured to accept the actuator. The actuator may comprise a mouthpiece handle. The controller may be configured to establish a stand-by mode of the heating element when the presence of the actuator is detected. The controller may be configured to establish an aerosol-generating mode of the heating element when absence of the actuator is detected.

According to another embodiment of the present disclosure, an aerosol-generating device comprises a body configured to receive an aerosol-generating substrate; a heating element configured to heat the aerosol-generating substrate; a power source operatively connected to the heating element; a controller configured to control the power source and the heating element; and a switch comprising a sensor to detect presence of an actuator, the switch being operatively connected to the controller. The switch may comprise a magnetic switch. The switch may comprise a magnetic docking station configured to accept the actuator. The actuator may comprise a mouthpiece handle. The controller may be configured to establish a stand-by mode of the heating element when the presence of the actuator is detected. The controller may be configured to establish an aerosol-generating mode of the heating element when absence of the actuator is detected.

According to an embodiment of the present disclosure, a method for using the aerosol-generating device may comprise placing the actuator adjacent the sensor and detecting the presence of the actuator; and controlling the power supply to the heating element. The method may comprise switching on the device, where upon switching on the device, the controller initiates a preheat mode. The method may comprise detecting presence or absence of the actuator, and controlling power supplied to the heating element in dependence on presence or absence of the actuator. Controlling may comprise maintaining the heating element at a first temperature, such as the preheat temperature or stand-by temperature. Controlling the heating element to the first temperature may be part of a stand-by mode. Controlling may comprise raising the temperature of the heating element to heat the aerosol-generating substrate from the first temperature to a second temperature, such as a use temperature or aerosol-generating temperature. Controlling the heating element to the second temperature may be part of an aerosol-generating mode. The method may comprise the controller selecting the stand-by mode upon detecting the presence of the actuator. The method may comprise the controller selecting the aerosol-generating mode upon detecting the absence of the actuator.

According to another embodiment of the present disclosure, a method for using the aerosol-generating device comprises placing the actuator adjacent the sensor and detecting the presence of the actuator; and controlling the power supply to the heating element. The method may comprise switching on the device, where upon switching on the device, the controller initiates a preheat mode. The method may comprise detecting presence or absence of the actuator, and controlling power supplied to the heating element in dependence on presence or absence of the actuator. Controlling may comprise maintaining the heating element at a first temperature, such as the preheat temperature or stand-by temperature. Controlling the heating element to the first temperature may be part of a stand-by mode. Controlling may comprise raising the temperature of the heating element to heat the aerosol-generating substrate from the first temperature to a second temperature, such as a use temperature or aerosol-generating temperature. Controlling the heating element to the second temperature may be part of an aerosol-generating mode. The method may comprise the controller selecting the stand-by mode upon detecting the presence of the actuator. The method may comprise the controller selecting the aerosol-generating mode upon detecting the absence of the actuator.

The term "aerosol" is used herein to refer to a suspension of solid particles or liquid droplets or a combination of solid particles and liquid droplets in a gas. The gas may be air. The solid particles or liquid droplets may comprise one or more volatile flavor compounds. Aerosol may be visible or invisible. Aerosol may include vapors of substances that are ordinarily liquid or solid at room temperature. Aerosol may include vapors of substances that are ordinarily liquid or solid at room temperature, in combination with solid particles or in combination with liquid droplets or in combination with both solid particles and liquid droplets. In some embodiments, the aerosol comprises nicotine.

The term "aerosol-forming substrate" is used herein to refer to a material capable of releasing one or more volatile compounds that can form an aerosol. In some embodiments, an aerosol-forming substrate may be heated to volatilize one or more components of the aerosol-forming substrate to form an aerosol. As an alternative to heating or combustion, in some cases volatile compounds may be released by a chemical reaction or by a mechanical stimulus, such as ultrasound. The aerosol-forming substrate may be disposed inside the cartridge. Aerosol-forming substrate may be solid or liquid or may comprise both solid and liquid components. Aerosol-forming substrate may be adsorbed, coated, impregnated or otherwise loaded onto a carrier or support. Aerosol-forming substrate may comprise nicotine. Aerosol-forming substrate may comprise plant-based material. Aerosol-forming substrate may comprise tobacco. Aerosol-forming substrate may comprise a tobacco-containing material containing volatile tobacco flavor compounds, which are released from the aerosol-forming substrate upon heating. Aerosol-forming substrate may alternatively comprise a non-tobacco-containing material. Aerosol-forming substrate may comprise homogenized plant-based material. Aerosol-forming substrate may comprise homogenized tobacco material. Aerosol-forming substrate may comprise at least one aerosol-former. Aerosol-forming substrate may comprise other additives and ingredients, such as flavorants.

The term "stand-by temperature" is used here to describe a temperature or temperature range targeted or achieved by the aerosol-generating device during stand-by mode. The temperature may refer to the temperature of the heating element active in stand-by mode or to the temperature of the aerosol-generating substrate.

The term "aerosol-generating temperature" is used here to describe a temperature or temperature range targeted or achieved by the aerosol-generating device during aerosol-generating mode. The temperature may refer to the temperature of the heating element active in aerosol-generating mode or to the temperature of the aerosol-generating substrate.

The terms "integral" and "integrally formed" are used herein to describe elements that are formed in one piece (a single, unitary piece). Integral or integrally formed components may be configured such that they cannot be separably removed from each other without causing structural damage to the piece.

As used herein, the singular forms "a," "an," and "the" also encompass embodiments having plural referents, unless the content clearly dictates otherwise.

As used herein, "or" is generally employed in its sense including "one or the other or both" unless the content clearly dictates otherwise.

The term "about" is used herein in conjunction with numeric values to include normal variations in measurements as expected by persons skilled in the art, and is understood to have the same meaning as "approximately."

The term "about" understood to cover a typical margin of error. A typical margin of error may be, for example, ±5% of the stated value.

As used herein, "have," "having," "include," "including," "comprise," "comprising" or the like are used in their open-ended sense, and generally mean "including, but not limited to". It will be understood that "consisting essentially of," "consisting of," and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

The term "substantially" as used herein has the same meaning as "significantly," and can be understood to modify the term that follows by at least about 90%, at least about 95%, or at least about 98%. The term "not substantially" as used herein has the same meaning as "not significantly," and can be understood to have the inverse meaning of "substantially," i.e., modifying the term that follows by not more than 10%, not more than 5%, or not more than 2%.

Any direction referred to herein, such as "top," "bottom," "left," "right," "upper," "lower," and other directions or orientations are described herein for clarity and brevity but are not intended to be limiting of an actual device or system. Devices and systems described herein may be used in a number of directions and orientations.

According to an embodiment, an aerosol-generating device comprises a body configured to receive an aerosol-generating substrate. The aerosol-generating device comprises a heating element that is configured to heat the aerosol-generating substrate. The heating element may be configured to heat the aerosol-generating substrate to an aerosol-generating temperature in which an aerosol may be generated. The heating element may be configured to heat the aerosol-generating substrate to a stand-by temperature. The stand-by temperature may be lower than the aerosol-generating temperature. The stand-by temperature may also be considered a pre-heat temperature.

Preferably, the heating element is an electrically heated heating element. The heating element may comprise one or more heating components. The one or more heating components may be similar or different in type and function. The one or more heating components may be configured to work simultaneously. The one or more heating components may be configured to work during specific operating modes. For example, the heating element may comprise a resistive heating component. The heating element may comprise an inductive heating component. In some embodiments, the heating element comprises a resistive heating component and an inductive heating component. The resistive heating component may be used to heat the aerosol-generating substrate to the stand-by temperature. The inductive heating component may be used to heat the aerosol-generating substrate to the aerosol-generating temperature. According to an embodiment, the controller may switch the device to a stand-by mode, in which the heating element is at a stand-by temperature or is heated to the stand-by temperature. According to an embodiment, the controller may switch the device to an aerosol-generating mode, in which the heating element is at an aerosol-generating temperature or is heated to the aerosol-generating temperature.

The aerosol-generating device comprises a power supply operatively connected to the heating element. Any suitable electrical power supply may be used. For example, the power supply may comprise a battery or set of batteries. The batteries of the power supply may be rechargeable, removable and replaceable, or rechargeable and removable and replaceable. Any suitable battery may be used. For example, heavy duty type or standard batteries existing in the market, such as used for industrial heavy-duty electrical power-tools. Alternatively, the power supply may be any type of electric power supply including a super or hyper-capacitor. Alternatively, the assembly may be connected to an external electrical power source, and electrically and electronically designed for such purpose. Regardless of the type of power supply employed, the power supply preferably provides sufficient energy for the normal functioning of the assembly for at least one shisha session until aerosol is depleted from the aerosol-forming substrate in the cartridge before being recharged or needing to connect to an external electrical power source. Preferably, the power supply provides sufficient energy for the normal functioning of the assembly for at least about 70 minutes of continuous operation of the device, before being recharged or needing to connect to an external electrical power source.

According to an embodiment, the aerosol-generating device comprises a controller. The controller may be configured to control the power source and the heating element. The controller may be configured to establish a stand-by mode of the heating element when the actuator is present. The controller may be configured to establish an aerosol-generating mode of the heating element when the actuator is absent. The controller may be configured to receive a signal from the switch.

According to an embodiment, the aerosol-generating device comprises a switch. The switch may be operatively connected to the controller. The switch and the controller may cooperate to change the heating mode of the heating element based on the presence or absence of an actuator.

In some embodiments, the switch may comprise a magnetic switch. The switch may comprise a magnetic docking station for an actuator. The actuator may be a mouthpiece or a portion thereof, such as a mouthpiece handle. The switch may be switched from one position or state to another when the actuator is brought into contact with the switch or is removed from the switch. The mouthpiece may be configured to be held in place by the magnet. The mouthpiece may comprise a coupling element configured to couple with the docking station. For example, the mouthpiece may comprise a magnet or material that is magnetic. The switch may correspondingly comprise material that is magnetic, or a magnet. The switch may be configured to detect the presence or absence of the actuator. The actuator may be configured to trigger the switch. The switch may be configured to detect the presence or absence of the mouthpiece handle. The mouthpiece handle may be configured to trigger the switch. The controller may be configured to establish a stand-by mode of the heating element when the mouthpiece handle is docked in the magnetic docking station. The controller may be configured to establish an aerosol-generating mode of the heating element when the mouthpiece handle is not docked in the magnetic docking station.

The switch may form a part of an electrical circuit. The switch may have a first position or first state where the electrical circuit is open (that is, electricity does not flow through the circuit). The switch may have a second position or second state where the electrical circuit is closed (that is, electricity may flow through the circuit). Placing the actuator adjacent the switch may cause the switch to be in the first position or first state. Removing the actuator from the vicinity of the switch may cause the switch to move to the second position or second state. Docking of the mouthpiece handle on the magnetic docking station may cause the switch to be in the first position or first state. Removing the mouthpiece handle from the magnetic docking station may cause the switch to move to the second position or second state.

The switch may comprise a sensor capable of detecting the presence or absence of the actuator. The switch may be configured to send a signal indicating the presence or absence of the actuator. Upon receiving a signal from the switch regarding the presence or absence of the actuator, the controller may control the power source and heating element to the stand-by mode (in the presence of the actuator) or to the aerosol-generating mode (in the absence of the actuator). The actuator may be a mouthpiece. The switch may comprise any suitable type of sensor, such as a magnetic sensor, an optical sensor, a conductivity sensor, a mechanical switch, etc. The switch may comprise a magnetic relay, an electrical relay, an electromagnetic relay, an electromechanical relay, or the like. In one embodiment, the switch comprises a magnetic relay. The switch may comprise a contact point configured to contact the actuator. The sensor may be positioned at the contact point. The contact point may also include a magnet. The magnet may also help position the mouthpiece handle at the contact point.

The aerosol-generating device may comprise a first electrical circuit and a second electrical circuit. The first electrical circuit may comprise a first heating component. The second electrical circuit may comprise a second heating component. At least one of the electrical circuits may comprise a capacitor operatively connected to the heating component on the circuit. The first electrical circuit may be a pre-heat circuit. The first electrical component may comprise a resistive heating element. The second electrical circuit may be a booster heat circuit. The second electrical component may comprise an inductive heating element. The second electrical circuit may comprise a capacitor. Inclusion of a capacitor in the circuit may provide faster heating and may help conserve the power supply (for example, a battery). The second electrical circuit may be configured to heat the aerosol-forming substrate to an aerosol-forming temperature. The second electrical circuit may be capable of heating the aerosol-generating substrate at a faster heating rate than the first electrical circuit.

A method for using the aerosol-generating device may comprise turning the device on. The method may comprise placing an actuator on the switch to actuate the switch to a first position or first state. The method may comprise detecting the presence of the actuator. Placing the actuator on the switch may comprise placing the actuator adjacent the sensor and detecting the presence of the actuator. Placing the actuator on the switch may comprise docking the actuator at a magnetic docking station. The method may comprise the controller selecting the stand-by mode upon detecting the presence of the actuator. The method may comprise establishing a stand-by mode of the heating element upon placing the actuator on the switch. The method may comprise establishing a pre-heat mode of the heating element upon placing the actuator on the switch. The method may comprise controlling the power supply to the heating element. Controlling may comprise heating the heating element to maintain the aerosol-generating substrate at a first temperature, such as the preheat temperature or stand-by temperature. Controlling the heating to the first temperature may be part of a stand-by mode.

The method may comprise removing the actuator to actuate the switch to a second position or second state. The method may comprise establishing an aerosol-generating mode of the heating element upon removal of the actuator. Removing the actuator may comprise removing the actuator from the magnetic docking station. The method may comprise detecting the absence of the actuator. Removing the actuator may comprise removing the actuator from the sensor and detecting the absence of the actuator. The method may comprise the controller selecting the aerosol-generating mode upon detecting the absence of the actuator. The method may comprise establishing an aerosol-generating mode of the heating element upon removal of the actuator from the switch. The method may comprise controlling the power supply to the heating element. Controlling may comprise raising the temperature of the heating element to heat the aerosol-generating substrate from the first temperature to a second temperature, such as a use temperature or an aerosol-generating temperature. Controlling the heating element to the second temperature may be part of an aerosol-generating mode. Placing the actuator on the switch again may re-establish the stand-by mode. Controlling may comprise reducing the temperature from the second temperature to the first temperature.

Establishing the stand-by mode may comprise initiating a first heating program of the heating element. The first heating program may comprise heating the aerosol-generating substrate received in the body to a first temperature. In some cases, the first temperature may be the temperature of the heating element or heating element component. The first temperature may be 100° C. or greater, 120° C. or greater, 140° C. or greater, or 160° C. or greater. The first temperature may be 200° C. or lower, 180° C. or lower, or 160° C. or lower. In some embodiments, the first temperature is in the range of 100° C. to 200° C., or 120° C. to 180° C. The first heating program may comprise using the first heating component.

Establishing the aerosol-generating mode may comprise initiating a second heating program of the heating element. The second heating program may comprise heating the aerosol-generating substrate received in the body to a second temperature. In some cases, the second temperature may be the temperature of the heating element or heating element component. The second temperature may be 160° C. or greater, 170° C. or greater, 180° C. or greater, or 200° C. or greater. The second temperature may be 260° C. or less, 240° C. or less, or 220° C. or less. In some embodiments, the second temperature is in the range of 160° C. to 260° C., or 170° C. to 240° C. The second heating program may comprise using the second heating component.

The aerosol-generating device may comprise a shisha system. The shisha system may be used by placing a cartridge in the receptacle; and turning on the shisha device. While the mouthpiece is on the docking station, the heating element may be in a stand-by mode. Initially, the heating element may be in a pre-heating phase. Once the temperature of the heating element or the aerosol-generating substrate has reached a target stand-by temperature, the heating element will remain in stand-by mode and will maintain the stand-by temperature. When the mouthpiece is removed from the docking station (for example, is picked up by the user) and is no longer detected by the sensor, the shisha device will switch to an aerosol-generating mode. In aerosol-generating mode, the heating element will heat the aerosol-generating substrate to an aerosol-generating temperature.

In some embodiments the cartridge is a shisha cartridge that may be used with any suitable shisha device. The shisha device may include a receptacle for receiving the cartridge. The shisha device may include a heating element configured to contact or to be in proximity to the body of the cartridge when the cartridge is received in the receptacle. The heating element may form at least part of the receptacle. For example, the heating element may form at least a portion of the surface of the receptacle. The shisha cartridge may be configured to transfer heat from the heating element to the aerosol-forming substrate in the cavity of the cartridge by conduction. In some embodiments, the heating element includes an electric heating element. In some embodiments, the heating element includes a resistive heating component. For example, the heating element may include one or more resistive wires or other resistive elements. The resistive wires may be in contact with a thermally conductive material to distribute heat produced over a broader area. Examples of suitable conductive materials include aluminum, copper, zinc, nickel, silver, and combinations thereof. The heating element may form at least a portion of the surface of the receptacle. In some embodiments, the heating element includes an inductive heating component. The inductive heating component may comprise an inductive coil. The inductive heating component may comprise a susceptor. In some embodiments, a susceptor material is included as part of the cartridge for aerosol-generating substrate or may be disposed inside the cartridge.

According to an embodiment, the aerosol-generating device includes a controller. The controller may be operably connected to the power supply. The controller may be operably connected to the switch. The controller may be operably connected to the heating element. The controller may be configured to control heating of the heating element. The controller may be configured to control the temperature to which the aerosol-forming substrate in the cartridge is heated. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware. The controller may comprise a microprocessor, which may be a programmable microprocessor. The controller may be configured to regulate a supply of power. The power may be supplied to the heater element in the form of pulses of electrical current.

The aerosol-generating device may include a controller comprising one or more processors (for example, microprocessors). The one or more processors may operate with associated data storage, or memory, for access to processing programs or routines and one or more types of data that may be employed to carry out the illustrative methods. For example, processing programs or routines stored in data storage may include programs or routines for controlling the power supply or heating element or both power supply and heating element, individually controlling each of the power supply and heating element, receiving inputs from a switch or sensor, implementing programs or schemes using the power supply and heating element, recalling one or more programs associated with one or more operating modes, supplying power to the one or more heating elements, and the heating of the one or more heating elements, standardization algorithms, comparison algorithms, or any other processing used to implement the one or more illustrative methods and processes described herein. The data storage, or memory, may be further configured to store data related to one or more processes or schemes for controlling the heating element, data and formulas related to one or more operating modes, such as a stand-by mode and an aerosol-generating mode, and any other data or formulas necessary to perform the processes and methods described herein.

In one or more embodiments, the method of using the aerosol-generating device may be described as being implemented using one or more computer programs executed on one or more programmable processors that include processing capabilities (for example, microcontrollers or programmable logic devices), data storage (for example, volatile or non-volatile memory or storage elements), input devices, and output devices. Program code, or logic, described herein may be applied to input data to perform functionality described herein and generate desired output information. The output information may be applied as input to one or more other devices or processes as described herein or as would be applied in a known fashion.

The computer program products used to implement the processes described herein may be provided using any programmable language, for example, a high-level procedural or object orientated programming language that is suitable for communicating with a computer system. Any such program products may, for example, be stored on any suitable device, for example, a storage media, readable by a general or special purpose program, controller apparatus for configuring and operating the computer when the suitable device is read for performing the procedures described herein. In other words, at least in one embodiment, the aerosol-generating method may be implemented using a non-transitory computer readable storage medium, configured with a computer program, where the storage medium so configured causes the computer to operate in a specific and predefined manner to perform functions described herein.

The exact configuration of the controller of the aerosol-generating device is not limiting and essentially any device capable of providing suitable computing capabilities and control capabilities to implement the method may be used. In view of the above, it will be readily apparent that the functionality may be implemented in any manner as would be known to one skilled in the art. As such, the computer language, the controller, or any other software/hardware which is to be used to implement the processes described herein shall not be limiting on the scope of the systems, processes, or programs (for example, the functionality provided by such processes or programs) described herein. The methods and processes described in this disclosure, including those attributed to the systems, or various constituent components, may be implemented, at least in part, in hardware, software, firmware, or any combination thereof. For example, various embodiments of the techniques may be implemented within one or more processors, including one or more microprocessors, DSPs, ASICs, FPGAs, CPLDs, microcontrollers, or any other equivalent integrated or discrete logic circuitry, as well as any combinations of such components. When implemented in software, the functionality ascribed to the systems, devices, and methods described in this disclosure may be embodied as instructions on a computer-readable medium such as RAM, ROM, NVRAM, EEPROM, FLASH memory, magnetic data storage media, optical data storage media, or the like. The instructions may be executed by one or more processors to support one or more embodiments of the functionality.

The controller may be configured to receive an input indicative of a desired mode. The mode may refer to one or more operational parameters over time. For example, the mode may refer to a heating temperature or a heating profile (for example, defining the temperature and rate of heating). For example, a stand-by mode may refer to a stand-by temperature. An aerosol-generating mode may refer to an aerosol-generating temperature. A user or manufacturer may define the specific temperature or heating profile for a mode. The input received by the controller may be an input form a sensor. The controller may be configured to receive an input from a sensor configured to sense the presence or absence of an actuator. The controller may be configured to receive an input from a sensor configured to sense the presence or absence of a mouthpiece. Based on the received input, the controller may be configured to initiate a mode, such as a stand-by mode or an aerosol-generating mode. Based on the received input, the controller may control the power to one or more heating elements. For example, the controller may turn power on to one or more heating elements. The controller may lower power input to one or more heating elements. The controller may turn off power to one or more heating elements. The controller may turn up power input to one or more heating elements.

In some examples, the control electronics may be configured to monitor the electrical resistance of the heating element and to control the supply of power to the heating element depending on the electrical resistance of the heating element. In this manner, the control electronics may regulate the temperature of the resistive element.

The aerosol-generating device may include a temperature sensor, such as a thermocouple. The temperature sensor may be operably coupled to the control electronics to control the temperature of the heating element. The temperature sensor may be positioned in any suitable location. For example, the temperature sensor may be configured to insert into the cartridge when received within the receptacle to monitor the temperature of the aerosol-forming substrate being heated. In addition or alternatively, the temperature sensor may be in contact with the heating element. In addition or alternatively, the temperature sensor may be positioned to detect temperature at an aerosol outlet of the aerosol-generating device or a portion thereof. The sensor may transmit signals regarding the sensed temperature to the controller. The controller may adjust heating of the heating elements in response to the signal to achieve a suitable temperature at the sensor.

In one example, an aerosol-generating device includes an aerosol-generating element that includes a cartridge receptacle, a heating element, an aerosol outlet, and an air inlet. The cartridge receptacle is configured to receive a cartridge according to the present disclosure containing the aerosol-forming substrate. The heating element may define at least part of a surface of the receptacle.

The aerosol-generating device includes an air inlet channel in fluid connection with the receptacle. In use, when the substrate inside the cartridge is heated, aerosol former components in the substrate vaporize. Air flowing from the air inlet channel through the cartridge becomes entrained with aerosol generated from the aerosol former components in the cartridge.

Some electrically heated aerosol-generating devices (for example, shisha devices) employ pre-heated air and typically employ an airflow path such that the air travels in the vicinity of the heat source upon puffing. Further, some electrically heated aerosol-generating devices employ elements that increase radiation heat transfer by increasing the heated surface area.

The air inlet channel may include one or more apertures through the cartridge receptacle such that air from outside the shisha device may flow through the channel and into the cartridge receptacle through the one or more apertures. If a channel includes more than one aperture, the channel may include a manifold to direct air flowing through the channel to each aperture. Preferably, the aerosol-generating device includes two or more air inlet channels.

As described in more detail below, the cartridge includes one or more openings (such as inlets or outlets) formed in the body, allowing air to flow through the cartridge. If the receptacle includes one or more inlet apertures, at least some of the inlets in the cartridge may align with the apertures in the top of the receptacle. The cartridge may include an alignment feature configured to mate with a complementary alignment feature of the receptacle to align the inlets of the cartridge with the apertures of the receptacle when the cartridge is inserted into the receptacle.

Air that enters the cartridge may flow across or through, or both across and through the aerosol-forming substrate, entraining aerosol, and exiting the cartridge and receptacle via an aerosol outlet. From the aerosol outlet, the air carrying the aerosol enters a vessel of the aerosol-generating device via the stem pipe.

The aerosol-generating device may include any suitable vessel defining an interior volume configured to contain a liquid and defining an outlet in the headspace above a liquid fill level. The vessel may include an optically transparent or opaque housing to allow a consumer to observe contents contained in the vessel. The vessel may include a liquid fill demarcation, such as a liquid fill line. The vessel housing may be formed of any suitable material. For example, the vessel housing may include glass or suitable rigid plastic material. Preferably, the vessel is removable from a portion of the aerosol-generating assembly comprising the aerosol-generation element to allow a consumer to fill, empty or clean the vessel.

The vessel may be filled to a liquid fill level by a consumer. The liquid preferably includes water, which may optionally be infused with one or more colorants, flavorants, or colorants and flavorants. For example, the water may be infused with one or both of botanical and herbal infusions.

Aerosol entrained in air exiting the aerosol outlet of the receptacle may travel through a conduit positioned in the vessel. The conduit may be coupled to the aerosol outlet of the aerosol-generating element and may have an opening below the liquid fill level of the vessel, such that aerosol flowing through the vessel flows through the opening of the conduit, then through the liquid, into headspace of the vessel and exits through a headspace outlet, for delivery to a consumer.

The cartridge may comprise any suitable body defining a cavity. Aerosol-forming substrate may be disposed in the cavity of the cartridge. The body is preferably formed from one or more heat resistant materials, such as a heat resistant metal or polymer. The body may comprise a thermally conductive material. For example, the body may comprise any of aluminum, copper, zinc, nickel, silver, any alloys thereof, and combinations thereof. Preferably, the body comprises aluminum.

The cartridge may be of any suitable shape. For example, the cartridge may have a shape configured to be received by a shisha device. The cartridge may have a substantially cuboidal shape, cylindrical shape, frustoconical shape, or any other suitable shape. Preferably, the cartridge has a generally cylindrical shape or a frustoconical shape.

The aerosol-generating device is configured to heat the aerosol-forming substrate in the cartridge. The device may be configured to heat the aerosol-forming substrate in the cartridge by conduction. The cartridge is preferably shaped and sized to allow contact with, or minimize distance from, a heating element of the aerosol-generating device to provide efficient heat transfer from the heating element to the aerosol-forming substrate in the cartridge. The heat may be generated by any suitable mechanism, such as by resistive heating or by induction. In order to facilitate inductive heating, the cartridge may be provided with a susceptor. For example, the cartridge body may be made from or include a material (for example, aluminum) that is capable of acting as a susceptor, or a susceptor material may be provided within the cavity of the cartridge. A susceptor material may be provided within the cavity of the cartridge in any form, for example a powder, a solid block, shreds, etc.

Any suitable aerosol-forming substrate may be provided in the cavity defined by the body of the cartridge. The aerosol-forming substrate is preferably a substrate capable of releasing volatile compounds. The aerosol-forming substrate is preferably a substrate capable of releasing compounds that may form an aerosol. The volatile compounds may be released by heating the aerosol-forming substrate. The volatile compounds may be released by a chemical reaction or by a mechanical stimulus, such as ultrasound. Aerosol-forming substrate may be solid or liquid or may comprise both solid and liquid components. Aerosol-forming substrate may be adsorbed, coated, impregnated or otherwise loaded onto a carrier or support.

The aerosol-forming substrate may comprise nicotine. The nicotine containing aerosol-forming substrate may comprise a nicotine salt matrix. The aerosol-forming substrate may comprise plant-based material. The aerosol-forming substrate preferably comprises tobacco. The tobacco containing material preferably comprises volatile tobacco flavor compounds, which are released from the aerosol-forming substrate upon heating. The aerosol-forming substrate may comprise homogenized tobacco material. Homogenized tobacco material may be formed by agglomerating particulate tobacco. The aerosol-forming substrate may alternatively or additionally comprise a non-tobacco-containing material. The aerosol-forming substrate may comprise homogenized plant-based material. Aerosol-forming substrate may comprise at least one aerosol-former. Aerosol-forming substrate may comprise other additives and ingredients, such as flavorants. Preferably, the aerosol-forming substrate is a shisha substrate. A shisha substrate is understood to mean a consumable material that is suitable for use in a shisha device. Shisha substrate may include molasses.

The aerosol-forming substrate may include, for example, one or more of: powder, granules, pellets, shreds, spaghettis, strips, or sheets. The aerosol-forming substrate may contain one or more of: herb leaf, tobacco leaf, fragments of tobacco ribs, reconstituted tobacco, homogenized tobacco, extruded tobacco, and expanded tobacco.

The aerosol-forming substrate may include at least one aerosol former. Suitable aerosol formers include compounds or mixtures of compounds which, in use, facilitate formation of a dense and stable aerosol and which are substantially resistant to thermal degradation at the operating temperature of the aerosol-generating device. Suitable aerosol formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may include any suitable amount of an aerosol former. For example, the aerosol former content of the substrate may be equal to or greater than 5% on a dry weight basis, and preferably greater than 30% by weight on a dry weight basis. The aerosol former content may be less than about 95% on a dry weight basis. Preferably, the aerosol former content is up to about 55%.

The aerosol-forming substrate preferably includes nicotine and at least one aerosol former. In some embodiments, the aerosol former is glycerine or a mixture of glycerine and one or more other suitable aerosol formers, such as those listed above.

The aerosol-forming substrate may include other additives and ingredients, such as flavorants, sweeteners, etc. In some examples, the aerosol-forming substrate includes one or more sugars in any suitable amount. Preferably, the aerosol-forming substrate includes invert sugar. Invert sugar is a mixture of glucose and fructose obtained by splitting sucrose. Preferably, the aerosol-forming substrate includes from about 1% to about 40% sugar, such as invert sugar, by weight. In some example, one or more sugars may be mixed with a suitable carrier such as cornstarch or maltodextrin.

In some examples, the aerosol-forming substrate includes one or more sensory-enhancing agents. Suitable sensory-enhancing agents include flavorants and sensation agents, such as cooling agents. Suitable flavorants include natural or synthetic menthol, peppermint, spearmint, coffee, tea, spices (such as cinnamon, clove, ginger, or combination thereof), cocoa, vanilla, fruit flavors, chocolate, eucalyptus, geranium, eugenol, agave, juniper, anethole, linalool, and any combination thereof.

In some examples, the aerosol-forming substrate is in the form of a suspension. For example, the aerosol-forming substrate may include molasses. As used herein, "molasses" means an aerosol-forming substrate composition comprising about 20% or more sugar. For example, the molasses may include at least about 25% by weight sugar, such as at least about 35% by weight sugar. Typically, the molasses will contain less than about 60% by weight sugar, such as less than about 50% by weight sugar.

Any suitable amount of aerosol-forming substrate (for example, molasses or tobacco substrate) may be disposed in the cavity. In some preferred embodiments, about 3 g to about 25 g of the aerosol-forming substrate is disposed in the cavity. The cartridge may include at least 6 g, at least 7 g, at least 8 g, or at least 9 g of aerosol-forming substrate. The cartridge may include up to 15 g, up to 12 g; up to 11 g, or up to 10 g of aerosol-forming substrate. Preferably, from about 7 g to about 13 g of aerosol-forming substrate is disposed in the cavity.

The aerosol-forming substrate may be provided on or embedded in a thermally stable carrier. The term "thermally stable" is used herein to indicate a material that does not substantially degrade at temperatures to which the substrate is typically heated (e.g., about 150° C. to about 300° C.). The carrier may comprise a thin layer on which the substrate deposited on a first major surface, on second major outer surface, or on both the first and second major surfaces. The carrier may be formed of, for example, a paper, or paper-like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose-derivative fibers.

The body of the cartridge may include one or more walls. In some embodiments, the body includes a top wall, a bottom wall, and a sidewall. The sidewall may be cylindrical or frustoconical, extending from the bottom to the top. The body may include one or more parts. For example, the sidewall and the bottom wall may be an integral single part. The sidewall and the bottom wall may be two parts configured to engage one another in any suitable manner. For example, the sidewall and the bottom wall may be configured to engage one another by threaded engagement or interference fit. The sidewall and the bottom wall may be two parts joined together. For example, the sidewall and the bottom wall may be joined together by welding or by an adhesive. The top wall and sidewall may be a single integral part. The sidewall and the top wall may be two parts configured to engage one another in any suitable manner. For example, sidewall and the top wall may be configured to engage one another by threaded engagement or interference fit. The sidewall and the top wall may be two parts joined together. For example, the sidewall and the top wall may be joined together by welding or by an adhesive. The top wall, sidewall and bottom wall may all be a single integral part. The top wall, the sidewall, and the bottom wall may be three separate parts configured to engage one another in any suitable manner. For example, the top wall, the sidewall, and the bottom wall may be configured to engage by threaded engagement interference fit, welding, or an adhesive.

One or more walls of the body may form a heatable wall or surface. As used herein, "heatable wall" and "heatable surface" mean an area of a wall or a surface to which heat may be applied, either directly or indirectly. The heatable wall or surface may function as a heat transfer surface through which heat may be transferred from outside of the body to the cavity or to an internal surface of the cavity.

Preferably, the body of the cartridge has a length (for example, an axial length along a vertical center axis) of about 15 cm or less. In some embodiments, the body has a length of about 10 cm or less. The body may have an inside diameter of about 1 cm or more. The inside diameter of the body may be about 1.75 cm or more. The cartridge may have a heatable surface area in the cavity from about 25 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. In some embodiments, the body has a length in a range from about 3.5 cm to about 7 cm. The inside diameter of the body may be from about 1.5 cm to about 4 cm. The body may have a heatable surface area in the cavity from about 30 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. Preferably, the body is cylindrical or frustoconical.

The cartridge body may include one or more openings or ventilation holes through one or more walls of the body. The ventilation holes may be inlets, outlets, or both. The ventilation holes may be disposed at the bottom wall, top wall, sides, or a combination thereof, of the cartridge. In some cases, the cartridge includes one or more inlets and one or more outlets to allow air to flow through the aerosol-forming substrate when the cartridge is used with an aerosol-generating device. In some cases, the top wall of the cartridge may be absent or may define one or more openings to form the one or more inlets of the cartridge. The bottom wall of the cartridge may define one or more openings to form the one or more outlets of the cartridge. Preferably, the one or more inlets and outlets are sized and shaped to provide a suitable resistance to draw (RTD) through the cartridge. In some examples, the RTD through the cartridge, from the inlet or inlets to the outlet or outlets, may be from about 10 mm $H_2O$ to about 50 mm $H_2O$, preferably from about 20 mm $H_2O$ to about 40 mm $H_2O$. The RTD of a specimen refers to the static pressure difference between the two ends of the specimen when it is traversed by an air flow under steady conditions in which the volumetric flow is 17.5 milliliters per second at the output end. The RTD of a specimen may be measured using the method set out in ISO Standard 6565:2002.

The one or more openings on the body may cover 5% or greater, 10% or greater, 15% or greater, 20% or greater, or 25% or greater of the area of the wall the openings are on. For example, if the openings are on the top wall, the openings may cover at least 5% of the area of the top wall. The one or more openings on the body may cover 75% or less, 50% or less, 40% or less, or 30% or less of the area of the wall the openings are on.

The cartridge may further include a seal or layer covering the one or more inlets and optionally a second seal or layer covering the one or more outlets prior to use. The cartridge may include a first removable seal covering the one or more inlets and a second removable seal covering the one or more outlets. The first and second seals are preferably sufficient to prevent air flow through the inlets and outlets to prevent leakage of the contents of the cartridge and to extend shelf life. The seal may comprise a peelable label of sticker, foil, or the like. The label, sticker, or foil may be affixed to the cartridge in any suitable manner, such as with an adhesive, crimping, welding, or otherwise being joined to the container. The seal may comprise a tab that may be grasped to peel or remove the label, sticker, or foil from the cartridge.

For purposes of example, one method for using an aerosol-generating device, such as a shisha device, as described herein is provided below in chronological order. The vessel may be detached from other components of the shisha device and filled with water. One or more of natural fruit juices, botanicals, and herbal infusions may be added to the water for flavoring. The amount of liquid added should cover a portion of the conduit but should not exceed a fill level mark that may optionally exist on the vessel. The vessel is then reassembled to the shisha device. The cartridge may be prepared by removing any removable layer (if present). A portion of the aerosol-generating element may be removed or opened to allow the cartridge to be inserted into the receptacle. The aerosol-generating element is then reassembled or closed. The device may then be turned on. The sensor may detect the presence of the mouthpiece on the docking station and may send a signal to the controller accordingly. Upon receipt of the signal, the controller may initiate a heating profile of the heating element according to a stand-by mode. The heating element may preheat the aerosol-generating substrate to a stand-by temperature. Removing the mouthpiece from the docking station may cause the sensor to detect the absence of the mouthpiece and to send a signal to the controller accordingly. Upon receipt of the signal, the controller may initiate a heating profile of the heating element according to an aerosol-generating mode. The heating element may be heated to heat the aerosol-forming substrate to a temperature at or above a vaporization temperature but below a combustion temperature of the aerosol-forming substrate. The aerosol forming compounds of the aerosol-forming substrate vaporize, generating an aerosol. The user may puff on the mouthpiece as desired. The user may continue using the device as long as desired or until no more aerosol is visible or being delivered. The user may set the mouthpiece back on the docking station. The sensor may detect the presence of the mouthpiece and send a signal to the controller accordingly. Upon receipt of the signal, the controller may initiate a heating profile of the heating element according to the stand-by mode. In some embodiments, the device may be arranged to automatically shut off when the cartridge or a compartment of the cartridge is depleted of usable aerosol-forming substrate. In some embodiments, the consumer may refill the device with a fresh cartridge after, for example, receiving the cue from the device that the aerosol-forming substrate in the cartridge is depleted or nearly depleted. The shisha device may be turned off at any time by a consumer by, for example, switching off the device.

The shisha device may have any suitable air management. In one example, puffing action from the user will create a suction effect causing a low pressure inside the device which will cause external air to flow through an air inlet of the device, into the air inlet channel, and into the receptacle. The air may then flow through the cartridge in the receptacle and become entrained with aerosol produced from the aerosol-forming substrate. The air with entrained aerosol then exits the aerosol outlet of the receptacle, flows through the conduit to the liquid inside the vessel. The aerosol will then bubble out of the liquid and into head space in the vessel above the level of the liquid, out the headspace outlet, and through the hose and mouthpiece for delivery to the consumer. The flow of external air and the flow of the aerosol inside the shisha device may be driven by the action of puffing from the user.

Reference will now be made to the drawings, which depict one or more embodiments described in this disclosure. However, it will be understood that other embodiments not depicted in the drawings fall within the scope and spirit of this disclosure. Like numbers used in the figures refer to like components. The use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Figure 1:
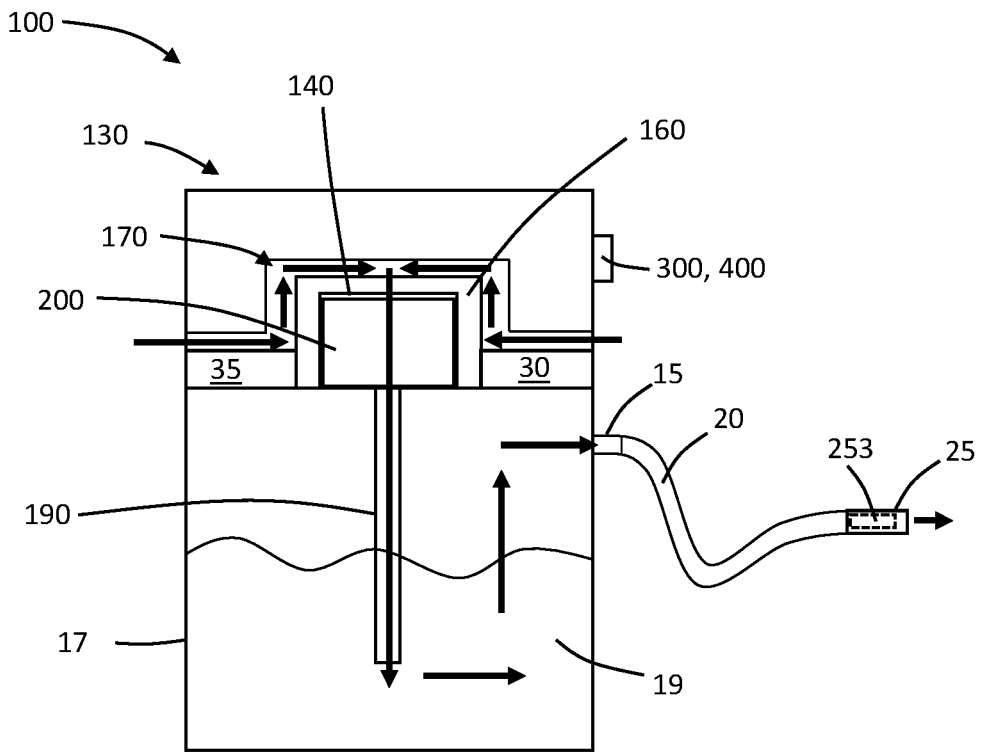
FIG. 1 is a schematic view of an aerosol-generating device.

FIG. 1 is a schematic sectional view of an example of an aerosol-generating device 100. The device 100 includes a vessel 17 defining an interior volume configured to contain liquid 19 and defining a headspace outlet 15 above a fill level for the liquid 19. The liquid 19 preferably includes water, which may optionally be infused with one or more colorants, one or more flavorants, or one or more colorants and one or more flavorants. For example, the water may be infused with one or both of botanical infusions and herbal infusions.

The device 100 comprises an aerosol-generating element 130. The aerosol-generating element 130 includes a receptacle 140 configured to receive a cartridge 200 comprising an aerosol-forming substrate. The aerosol-generating element 130 may also include a heating element 160. The heating element 160 may form at least one surface of the receptacle 140. In the depicted embodiment, the heating element 160 defines the side surfaces of the receptacle 140. The aerosol-generating element 130 also includes an air inlet channel 170 that draws air into the device 100. In some embodiments, portion of the air inlet channel 170 is formed by the heating element 160 to heat the air before the air enters the receptacle 140. The pre-heated air then enters the cartridge 200, which is also heated by heating element 160, to carry aerosol generated by the aerosol former and the aerosol-forming substrate. The air exits an outlet of the aerosol-generating element 130 and enters a conduit 190.

The conduit 190 carries the air and aerosol into the vessel 17 below the level of the liquid 19. The air and aerosol may bubble through the liquid 19 and exit the headspace outlet 15 of the vessel 17. A hose 20 may be attached to the headspace outlet 15 to carry the aerosol to the mouth of a user. A mouthpiece 25 may be attached to, or form a part of, the hose 20. An exemplary air flow path of the device, in use, is depicted by thick arrows in FIG. 1. The mouthpiece 25 is disposed at the downstream end of the hose 20.

According to an embodiment, the device 100 comprises a docking station 300 for the mouthpiece 25. The docking station 300 may comprise a switch 400. The switch 400 may be operably connected the controller 30. The mouthpiece 25 may comprise a coupling element 253. The coupling element 253 may be configured to couple with the docking station 300. For example, the docking station 300 may comprise a magnet, and the coupling element 253 may comprise magnetic material. The docking station 300 may be placed at any suitable location of the device 100, such as on the device body. The switch 400 may be configured to send a signal to the controller 30 indicating the presence or absence of the mouthpiece 25. The switch 400 may be in wired or wireless communication with the controller 30. The controller 30 may be operatively connected to the power supply 35. The controller 30 may be operatively connected to the heating element 160.

The controller 30 and power supply 35 may be located in any suitable position of the aerosol-generating element 130, including locations other than the bottom portion of the element 130 as depicted in FIG. 1.

Figure 2A:
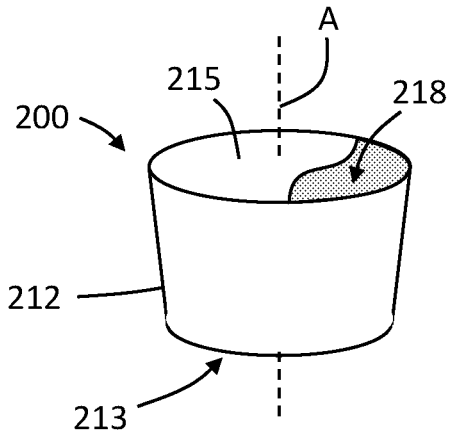
FIGS. 2A and 2B are schematic side and bottom perspective views, respectively, of the body of a shisha cartridge for use in the aerosol-generating device of FIG. 1 according to an embodiment.
Figure 2B:
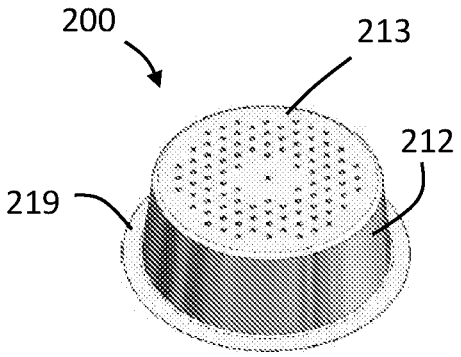

Referring now to FIGS. 2A and 2B, various embodiments of the cartridge 200 are shown. The cartridge 200 may include a side wall 212, a top wall 215, and a bottom wall 213 defining a cavity 218. The side wall 212 may be cylindrical or frustoconical, as shown. FIG. 2A shows the cartridge 200 with a portion of the top 215 removed, showing the cavity 218 inside the body. The cartridge 200 may define a center axis A extending through the cartridge 200. The top may comprise a flange 219 that extends from the sidewall 212 as shown in FIG. 2B. The flange 219 may rest on shoulder of a receptacle of a shisha device so that cartridge 200 may be readily removed from the receptacle after use by grasping the flange.

Figure 3A:
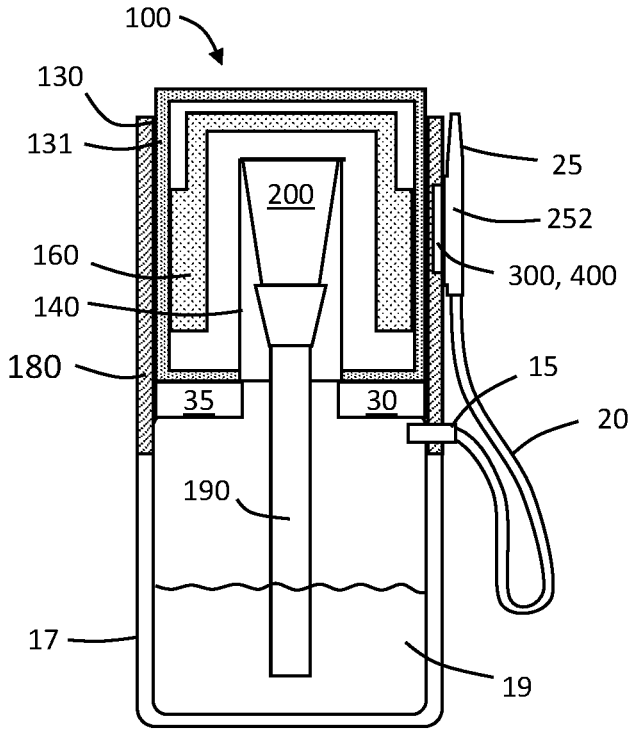
FIGS. 3A and 3B are schematic views of a shisha device according to an embodiment.
Figure 3B:
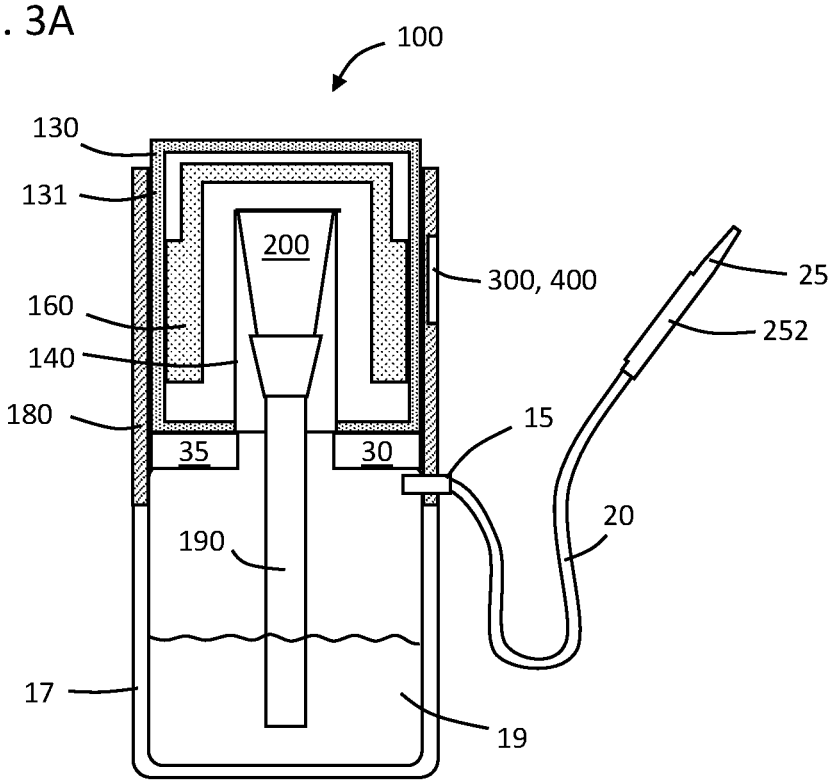

FIGS. 3A and 3B depict the aerosol-generating device 100 with the mouthpiece 25 docked at the docking station 300 and removed from the docking station 300, respectively. The docking station 300 may be disposed anywhere along the housing 180 of the device. For example, the docking station 300 may be built into the wall of the housing 180. The aerosol-generating element 130 may comprise a cap 131. The cap 131 may be removably partially disposed within the housing 180.

In FIG. 3A the mouthpiece handle 252 is coupled with the docking station 300. A user may remove the mouthpiece 25 from the docking station 300, as shown in FIG. 3B. According to an embodiment, the switch 400 is capable of sensing the presence of the mouthpiece 25. According to an embodiment, the switch 400 is capable of sending a signal to the controller 30 regarding the presence of the mouthpiece 25 on the docking station 300 as in FIG. 3A, or the absence of the mouthpiece 25 from the docking station 300, as in FIG. 3B.

Figure 4A:
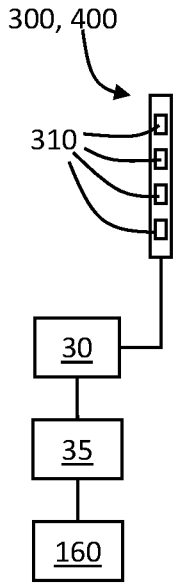
FIG. 4A is a schematic view of a switch and control system of the shisha device of FIGS. 3A and 3B according to an embodiment.

The docking station 300 and switch 400 may be operatively connected to the controller 30, as shown in FIG. 4A. The connection may be a wired connection or a wireless connection. The controller 30 may be operatively connected to the power supply 35. The controller 30 may be operatively connected to the heating element 160. The power supply 35 may be operatively connected to the heating element 160.

Figure 4B:
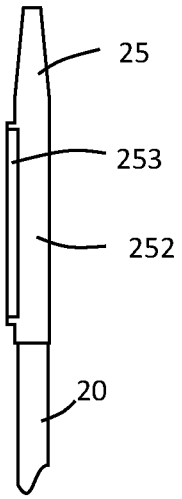
FIG. 4B is a schematic view of a mouthpiece of the shisha device of FIGS. 3A and 3B according to an embodiment.

The docking station 300 may comprise one or more magnets 310. The one or more magnets 310 may be configured to receive the mouthpiece 25, shown in FIG. 4B. The one or more magnets 310 may form part of an electrical circuit. The electrical circuit may also comprise one or more of the controller 30, the power supply 35, and the heating element 160. The one or more magnets 310 may form the switch 400 or a part thereof. Docking the mouthpiece 25 on the docking station 300 may cause the electrical circuit to open. Docking the mouthpiece 25 on the docking station 300 may cause switch 400 to move to a first position or first state. In the first position or first state, the switch 400 may send a signal to the controller 30 indicating the presence of the mouthpiece 25. In response, the controller 30 may initiate a stand-by mode or may turn power off to the heating element 160. Removing the mouthpiece 25 from the docking station 300 may cause the electrical circuit to close. Removing the mouthpiece 25 from the docking station 300 may cause the switch to move to the second position or second state. In the second position or second state, the switch 400 may send a signal to the controller 30 indicating the absence of the mouthpiece 25. In response, the controller 30 may initiate an aerosol-generating mode.

The mouthpiece 25 may comprise a mouthpiece handle body 252 connected to the hose 20. The mouthpiece 25 may comprise a coupling element 253. The coupling element 253 may form a part of the mouthpiece handle body 252. The coupling element 253 may be embedded in the mouthpiece handle body 252. The coupling element 253 may be disposed on the surface of the mouthpiece handle body 252. The coupling element 253 may comprise a magnet or magnetic material.

Figure 5A:
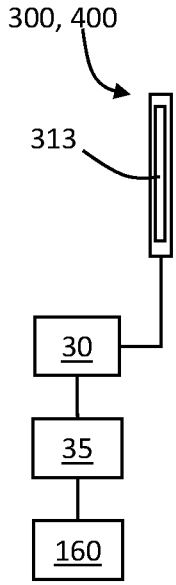
FIG. 5A is a schematic view of a switch and control system of the shisha device of FIGS. 3A and 3B according to an embodiment.
Figure 5B:
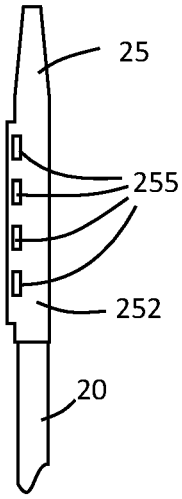
FIG. 5B is a schematic view of a mouthpiece of the shisha device of FIGS. 3A and 3B according to an embodiment.

According to another embodiment shown in FIGS. 5A and 5B, the one or more magnets 255 are disposed in the mouthpiece handle body 252. A corresponding coupling element 313 is disposed in the switch 400. Alternatively, magnets may be disposed in both the mouthpiece handle body 252 and the switch 400. Bringing the one or more magnets 255 of the mouthpiece 25 adjacent or in contact with the switch 400 may trigger the switch 400 and initiate an operational mode, such as a stand-by mode. Removing the one or more magnets 255 of the mouthpiece 25 from the switch 400 may trigger the switch 400 and initiate another operational mode, such as an aerosol-generating mode.

Thus, aerosol-generating devices with a switch are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, chemical arts, and aerosol-generating article manufacturing or related fields are intended to be within the scope of the following claims.

The invention claimed is:

1. An aerosol-generating device comprising:

a body comprising a cartridge receptacle configured to receive a cartridge with an aerosol-generating substrate, and a heating element configured to heat the aerosol-generating substrate;

a power source operatively connected to the heating element;

a controller configured to control the power source and the heating element;

a switch comprising a sensor to detect presence of an actuator, the switch operatively connected to the controller; and a mouthpiece handle removably coupled with the body, wherein the mouthpiece handle forms the actuator, wherein the controller is configured to establish a stand-by mode of the heating element when the presence of the actuator is detected, and wherein the controller is configured to establish an aerosol-generating mode of the heating element when absence of the actuator is detected.

2. The aerosol-generating device according to claim 1, wherein the switch comprises a magnetic switch.

3. The aerosol-generating device according to claim 2, wherein the switch comprises a magnetic docking station configured to accept the actuator.

4. The aerosol-generating device according to claim 1, wherein the heating element comprises one or both of:

a first heating element component comprising a resistive heating component; and a second heating element component comprising an inductive heating component.

5. The aerosol-generating device according to claim 1, further comprising a capacitor operatively connected to the heating element.

6. A method for using an aerosol-generating device, the device comprising:

a body comprising a cartridge receptacle configured to receive a cartridge with an aerosol-generating substrate, and a heating element configured to heat the aerosol-generating substrate;

a power source operatively connected to the heating element;

a controller configured to control the power source and the heating element;

a switch comprising a sensor to detect presence of an actuator, the switch being operatively connected to the controller; and a mouthpiece handle removably coupled with the body, wherein the mouthpiece handle forms the actuator, wherein the controller is configured to establish a stand-by mode of the heating element when the presence of the actuator is detected, and wherein the controller is configured to establish an aerosol-generating mode of the heating element when absence of the actuator is detected;

the method comprising:

placing the actuator adjacent the sensor and detecting the presence of the actuator; and controlling power supply to the heating element.

7. The method according to claim 6, further comprising:

removing the actuator and detecting the absence of the actuator; and establishing an aerosol-generating mode of the heating element.

8. The method according to claim 6, wherein the switch comprises a magnetic switch.

9. The method according to claim 8, wherein the switch comprises a magnetic docking station configured to accept the actuator and wherein placing the actuator adjacent the sensor comprises docking the actuator at the magnetic docking station.

10. The method according to claim 6, the method further comprising establishing a stand-by mode of the heating element, wherein in the stand-by mode, the heating element heats an aerosol-generating substrate received in the body to a first temperature.

11. The method according to claim 6, wherein in the aerosol-generating mode, the heating element heats an aerosol-generating substrate received in the body to a second temperature.

12. The method of claim 10, wherein the first temperature is 100° C. or greater.

13. The method of claim 10, wherein the first temperature is 200° C. or lower.

14. The method of claim 11, wherein the second temperature is 160° C. or greater.

15. The method of claim 11, wherein the second temperature is 260° C. or lower.

16. The aerosol-generating device according to claim 1 further comprising a vessel configured to contain liquid and to have a headspace above the liquid, wherein the vessel comprises a headspace outlet, and wherein the mouthpiece handle is coupled to a hose attached to the headspace outlet.

17. The aerosol-generating device according to claim 1, wherein the mouthpiece handle comprises one or more magnets.

* * * * *